US006028292A

United States Patent [19]

Willkens et al.

[11] Patent Number: 6,028,292

[45] Date of Patent: Feb. 22, 2000

[54] CERAMIC IGNITER HAVING IMPROVED OXIDATION RESISTANCE, AND METHOD OF USING SAME

[75] Inventors: Craig A. Willkens, Sterling; Linda S. Bateman, Spencer; Roger Lin, Shrewsbury, all of Mass.

[73] Assignee: Saint-Gobain Industrial Ceramics, Inc., Worchester, Mass.

[21] Appl. No.: 09/217,793

[22] Filed: Dec. 21, 1998

[51] Int. Cl.[7] ..... F23Q 7/22

[52] U.S. Cl. ..... 219/270; 219/260

[58] Field of Search ..... 219/270, 260, 219/552, 544, 553, 257, 516, 501; 501/98.4, 98.5, 98.6

[56] References Cited

U.S. PATENT DOCUMENTS

| | | | |
|---|---|---|---|
| 4,634,837 | 1/1987 | Ito et al. | 219/270 |
| 4,804,823 | 2/1989 | Okuda et al. | 219/553 |
| 4,912,305 | 3/1990 | Tatemasu et al. | 219/544 |
| 5,045,237 | 9/1991 | Washburn | 252/516 |
| 5,191,508 | 3/1993 | Axelson et al. | 361/257 |
| 5,233,166 | 8/1993 | Maeda et al. | 219/552 |
| 5,786,565 | 7/1998 | Willkens et al. | 219/260 |
| 5,801,361 | 9/1998 | Willkens et al. | 219/270 |

*Primary Examiner*—Philip H. Leung
*Assistant Examiner*—Quang Van
*Attorney, Agent, or Firm*—Thomas M. DiMauro

[57] ABSTRACT

This invention relates to a support zone for a hairpin-style ceramic igniter, the support zone comprising AlN and SiC, and preferably alumina.

28 Claims, 1 Drawing Sheet

CERAMIC IGNITER HAVING IMPROVED OXIDATION RESISTANCE, AND METHOD OF USING SAME

BACKGROUND OF THE INVENTION

Ceramic materials have enjoyed great success as igniters in gas fired furnaces, stoves and clothes dryers. A ceramic igniter typically has a hairpin or U-shape which contains conductive end portions and a highly resistive middle portion. When the igniter ends are connected to electrified leads, the highly resistive middle portion (or "hot zone") rises in temperature.

The art of ceramic igniters has long known of hairpin-shaped igniters which further have an electrically non-conductive ceramic insert disposed between their electrically resistive legs for support. JP-A-02094282 specifically discloses a ceramic igniter having $SiC/ZrB_2$ resistive legs and an AlN insulating insert (or "support zone")disposed between the resistive legs. JP-A-02094282 further teaches adding BN to the AlN insert in order to match the coefficients of thermal expansion ("CTE") of the two regions. Similarly, U.S. Pat. No. 5,191,508 ("Axelson")discloses a hairpin-shaped ceramic igniter having an "electrically non-conductive" insert, and teaches that the insert should be made from a single material such as alumina, aluminum nitride, beryllium oxide, each of which are electrically insulating materials. U.S. Pat. No. 4,634,837 ("Ito") discloses a ceramic igniter having a $Si_3N_4/MoSi_2$-based hot zone and a $Si_3N_4/Al_2O_3$ insert.

The art also discloses ceramic igniters in which conductive filaments are embedded in insulative ceramic materials. For example, U.S. Pat. No. 4,912,305 ("Tatemasu") discloses a tungsten wire embedded in a $Si_3N_4/Al_2O_3/Y_2O_3$ ceramic body. U.S. Pat. No. 4,804,823 ("Okuda") discloses a ceramic igniter in which a TiN or WC conductive ceramic layer (which also contains $Si_3N_4$) is disposed within a ceramic substrate of either AlN or $Si_3N_4$. Okuda also discloses that the substrate may further contain a sintering aid such as an oxide, nitride, or oxynitride of Groups Iia or IIIa of the Periodic Table or Aluminum. See column 7 lines 50–55.

Although the insert material in hairpin shaped igniters is generally highly electrically insulating, there are instances in which the art has disclosed inserts having some electrically conductive (such as $MoSi_2$) and/or semiconductive components (such as SiC). For example, JP-A-02086 ("JP '086") provides one such disclosure wherein the main constituent of the insert is silicon carbide. However, research has shown that the high temperature resistivities of a first material comprising SiC and a conductive material such as aluminum and a second material comprising over 99% SiC tend to equalize at high temperatures. Therefore, if these materials were to be used respectively as a hot zone and an insert in the same igniter, there would likely be electrical shorts across the insert material. In another example, U.S. Pat. No. 5,233,166 ("Maeda") discloses an igniter having a hot zone embedded in a ceramic substrate comprising silicon nitride, 8–19% rare earth oxide, 2–7% silica, and 7–20% $MoSi_2$. Maeda teaches to avoid producing a glass phase having alumina in an amount of more than 1 wt %.

U.S. Pat. No. 5,801,361 (Willkens '361) discloses a ceramic igniter designed for use in high voltage applications (220 V–240 V) in which the conventional hairpin-shaped hot zone is supported by ceramic material both between its legs and outside of its legs by support zones. Willkens '361 also teaches that this support zone material should be electrically insulating (i.e., should have an electrical resistivity of at least $10^6$ ohm-cm) and should preferably comprise at least 90 vol % of at least one of aluminum nitride, boron nitride and silicon nitride. Willkens '361 further discloses that this support zone material should not only possess thermal expansion and densification characteristics which are compatible with the hot zone, but also help protect the hot zone from oxidation (i.e., less than 10% amperage decrease over 30,000 cycles). In a WIPO publication corresponding to Willkens '361, the suggested electrical resistivity of the support zone material is $10_8$ ohm-cm.

However, although the igniter of Willkens '361 attains the required performance specifications for voltage applications, continued use of the igniter revealed significant long-term use failures in one support zone consisting essentially of aluminum nitride (AlN). That is, the resistance of this igniter increased significantly during extended use trials. Furthermore, densification problems (likely due to thermal expansion mismatch) were encountered with these support zones during manufacture. Lastly, Willkens '361 observed that, in one example, the white-hot glow of the hot zone (which had a room temperature resistivity of about 0.3 ohm-cm) tended to creep downwards, and suggested that this creep was caused by current flowing through the aluminum nitride-based insert.

U.S. Pat. No. 5,786,565 (Willkens '565) discloses another ceramic igniter having a support zone (or "insert")disposed between the two parallel legs of the igniter. According to Willkens '565, this insert is referred to as an "electrically insulating heat sink" or as an "electrically non-conducting heat sink", preferably has a resistivity of at least about $10^4$ ohm-cm. Preferably, the composition of the insert comprises at least 90 vol % of at least one of aluminum nitride, boron nitride and silicon nitride, but more preferably it consists essentially of at least one of aluminum nitride, boron nitride and silicon nitride.

However, although the igniters of Willkens '565 were found to possess impressive speed, their long term use at temperatures of about 1300° C. again resulted in a significant percentages of failures.

Therefore, there is a need for a aluminum nitride-based support zone which does not alter the electrical characteristics of the igniter, does not develop oxidation problems during use, and does not pose densification nor machining problems during manufacture. In particular, there is a need for a support zone which solves these problems for the igniter disclosed in Willkens '565.

SUMMARY OF THE INVENTION

In an effort to discover the reason for the unacceptable oxidation of the AlN-based support zone (or "insert") material, the present inventors undertook extensive investigations, and found an extensive and incoherent layer of alumina on the surface of the AlN. Since alumina has a much higher CTE than AlN, and the oxidation of AlN also produces a 6% expansion in volume, it is believed that the oxidation of the AlN insert material (that is, the production of alumina) causes cracking in the insert material and is the cause for the long term use failures.

Concurrently, the present inventors also examined conventional igniters possessing conventional $AlN-SiC-MoSi_2$ hot zone compositions which did not suffer from similar long term oxidation-related failures. It was found that, after long term use, these conventional hot zones had a coherent surface layer containing a substantial amount of mullite, which has a composition of $3Al_2O_3$-$2SiO_2$. In contrast to alumina, mullite has a CTE which is much more compatible with AlN, and produces only a small volumetric change when produced from AlN. Therefore, without wishing to be tied to a theory, it is believed that the production of a mullite surface layer is critical to the success of an AlN-based insert material.

In light of the above discovery, it was believed that the desired mullite layer could be produced by adding between 2 vol % and 40 vol % of a silicon-containing ceramic material such as silicon carbide to the AlN-based insert. Subsequent manufacture and testing of this composition confirmed the presence of the desired coherent mullite layer. Thus, it is believed that oxidation problems in AlN-based inserts can be significantly ameliorated by adding sufficient silicon-containing ceramics to produce a coherent layer of mullite on top of the AlN insert.

The finding of the suitability of a AlN-SiC insert material is surprising in light of the teachings of the art respecting the known characteristics of the conventional insulator systems. In regards to AlN, it was known that an essentially AlN insulator produced unacceptable oxidation in Willkens '361. In regards to SiC, it was known that an essentially SiC support zone produced unacceptable electrical shorting at high temperatures. Accordingly, there was serious concern that a mixture containing significant amounts of both compounds would produce either unacceptable oxidation, or shorting, or both. Instead, it was found that this new support zone provided both acceptable oxidation resistance and no shorting.

Therefore, in accordance with the present invention, there is provided a ceramic igniter comprising:

(a) a pair of conductive ends, and (b) a ceramic hot zone disposed between the cold ends, and (c) a support zone upon which the hot zone is disposed, wherein the support comprises:

(a) between about 50 and about 80 vol % aluminum nitride, and (b) between about 2 vol % and about 40 vol % of a silicon-based ceramic (preferably silicon carbide).

DETAILED DESCRIPTION OF THE INVENTION

Figure 1:
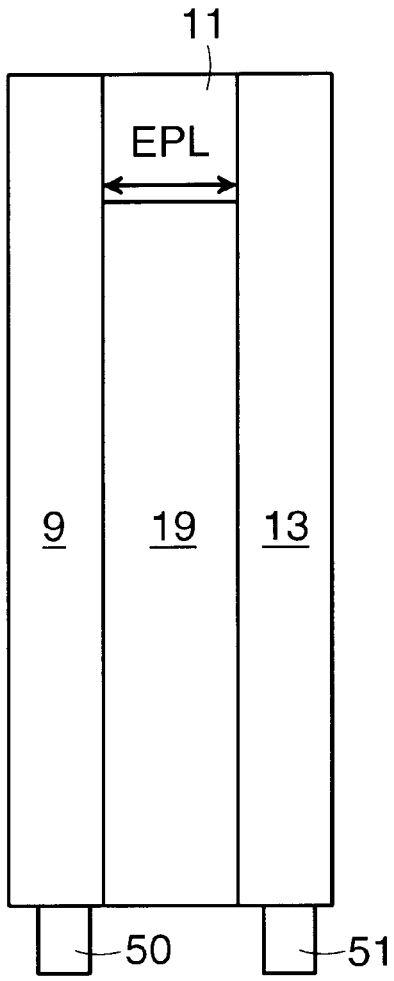
FIG. 1 is a preferred embodiment wherein one preferred igniter has a hairpin shape comprising two conductive legs 9 and 13 placed in electrical connection by a resistive hot zone 11, the legs 13 extending from the hot zone in the same direction, and an insert 19 is disposed between the conductive legs 13.

In general, the support zone comprises between 50 vol % and 80 vol % aluminum nitride as an insulating phase. If the support contains less than 50 vol % AlN, then the support may be too conductive and there is a danger of shorting. If the support contains more than 80 vol % AlN, then there is typically a risk of increased oxidation.

In general, the support zone further comprises between 2 vol % and 40 vol % of an silicon-based ceramic. If the support contains less than 2 vol % of the silicon-based ceramic, then there is insufficient reactant to form mullite and the support is too prone to oxidation. If the support contains more than 40 vol % of this phase, then there is typically a risk of shorting at high temperatures, even if the resulting ceramic support is only moderately conductive (i.e., a semiconductor). Preferably, the silicon-based ceramic is silicon carbide. Silicon carbide has a sufficient silicon content to form the desired mullite coating and is not so conductive as to cause shorting in the resulting composite insert material when present in the insert in amounts less than about 40 vol %.

In some preferred embodiments, the silicon carbide comprises between 10 vol % and 40 vol % of the support zone. In some embodiments, the silicon-based ceramic consists essentially of SiC, preferably in an amount of from about 20 vol % to about 40 vol %.

In some embodiments which preferably are used with the MIM design disclosed in Willkens '565, the insert comprises between 20 and 35 vol % SiC, preferably between 25 and 35 vol % SiC.

In some embodiments in which the insert material of the present invention is matched with Washburn-type conductive (cold) zones and hot zones, the coefficient of thermal expansion of the insert material may be too low. For example, in one experiment, it was found that an insert material consisting essentially of 70% AlN and 30% SiC cracked when it was substantially contacting a conductive zone comprising 20% AlN, 60% SiC and 20% $MoSi_2$. It is believed this failure was caused by a CTE mismatch between the insert and the conductive zone. When about 10% alumina was subsequently added to the insert, the densification was successful. Accordingly, in some embodiments, the support zone may further comprise between 2 vol % and 20 vol % of a high CTE ceramic having a thermal expansion coefficient of at least $6\times10^{-6}/°$ C. Preferably, the high CTE ceramic is alumina. In some experiments in which the insert was in substantial contact with a conductive zone containing 20% AlN, 20% $MoSi_2$ and 60% SiC, a significant number of the inserts containing 5% alumina still had cracks while essentially all the inserts having 10% alumina displayed no cracks. Therefore, in some embodiments, the insert preferably contains between 5 and 15% alumina, preferably between 8 and 15 vol % alumina. The finding that alumina can be beneficial to the insert composition is surprising because Maeda teaches that more than a few percent alumina addition to the insert will cause an undesirable glass phase.

In some embodiments, in which the SiC level in the insert is relatively low (i.e., less than 25 vol % SiC), it was found that a further addition of a small amount of molybdenum disilicide to the insert helped to increase oxidation resistance. Therefore, in some embodiments, the support zone may further comprises between 1 vol % and 4 vol % $MoSi_2$, particularly where the SiC content is relatively low. Because of the desirable effect $MoSi_2$, has on the oxidation resistance of the support zone, it is hypothesized that, in some embodiments containing between 1–4 vol % $MoSi_2$, as little as 10 vol % SiC will be needed to produce the desired oxidation resistance. Therefore, in some preferred embodiments, the insert comprises between 10 vol % and 25 vol % SiC (more preferably between 10 vol % and 20 vol % SiC) and between 1 vol % and 4 vol % $MoSi_2$. It has also been found that the addition of $MoSi_2$ changes of the color of the insert. Therefore, if a distinguishing color is desired, it is preferable not to use $MoSi_2$ to do so.

In addition, it was further found that use of molybdenum disilicide produces a different type of oxide layer. In particular, the oxide produced in $MoSi_2$-containing support zones also contains mullite, but it is thinner and more coherent than the oxide layer produced from AlN-SiC-$Al_2O_3$ support zones. Moreover, the layer produced by the $MoSi_2$ addition appears to be qualitatively more similar to that produced by the conventional Washburn hot zone.

It is further believed that tungsten disilicide may perform the same function as $MoSi_2$. Therefore, in some embodiments, the support zone further comprises:

(c) between about 1 vol % and about 4 vol % of a metallic conductor selected from the group consisting of molybdenum disilicide and tungsten disilicide, and mixtures thereof.

It is further believed that some of the support zones of the present invention may constitute novel compositions. Therefore, also in accordance with the present invention, there is provided a densified polycrystalline ceramic comprising (and preferably consisting of):

a) between 50 and 80 vol % aluminum nitride, b) between 25 and 35 vol % SiC, and c) between 8 and 15 vol % alumina.

Also in accordance with the present invention, there is provided a densified polycrystalline ceramic comprising (and preferably consisting of):

a) between 50 and 80 vol % aluminum nitride, b) between 10 and 25 vol % SiC, c) between 8 and 15 vol % alumina, and d) between 1 and 4 vol % molybdenum disilicide.

Preferably, the conductive ceramic zone and the hot zone define a hairpin having a pair of legs, and the support zone is disposed between the legs to define a contact length, wherein the support zone contacts (i) the conductive zone substantially along the legs and (ii) the hot zone substantially at the apex. This is the design substantially disclosed in Willkens U.S. Pat. No. 5,786,565 (the specification of which is wholly incorporated by reference herein), and generally referred to as the MIM design. In general, the contact between the support and the cold zone in this MIM design comprises at least 80% of the contact length.

It is further believed that using a hairpin MIM igniter design also helps ameliorate oxidation/shorting problems. In conventional hairpin-insert systems, the hot zone spans a significant portion of each leg region of the hairpin and also has a relatively high resistivity in comparison to the insert disposed between the hot zone regions. Because the relative resistivities of these zones was not very high (about 10 fold, or one decade), some electricity probably flowed from one hot zone through the insulator to the other hot zone. In contrast, in the MIM design, a conductive region spans essentially each entire leg. Since the relative resistivities of these regions is typically much higher (about 1000 fold), much less electricity probably flows through the insulator.

In addition, because the hot zone of a MIM design is situated essentially only at the apex of the hairpin, only a relatively small portion of the insert is exposed to high temperatures, thereby reducing the chances that it will become susceptible to oxidation.

Also without wishing to be tied to a theory, it is believed that using the present insert composition in systems having an operating voltage which is lower than the 24 V system used by Willkens '361 contributed to the essential absence of shorting through the AlN-based insert.

A low voltage drop across the igniter element helps prevent the shorting through the insulator due to the relative resistances of the insulator and the hot zone.

The hot zone provides the functional heating for gas ignition. In preferred embodiments, the component fractions of aluminum nitride, molybdenum disilicide and silicon carbide disclosed in U.S. Pat. No. 5,045,237, the specification of which is wholly incorporated by reference herein, are used. As indicated in the Washburn patent, the AlN-SiC-$MoSi_2$ system is a flexible one which can produce igniters having resistivities ranging from about 0.001 to about 100 ohm-cm. These hot zones generally have a resistivity of between 0.04 ohm-cm and 100 ohm-cm, and preferably between 0.2 ohm-cm and 100 ohm-cm in the temperature range of 1000 to 1500° C. Typically, the hot zone comprises:

(a) between about 50 and about 75 vol % aluminum nitride (b) between about 10 and about 45 vol % of a semiconductive material selected from the group consisting of silicon carbide and boron carbide, and mixtures thereof, and (c) between about 8.5 and about 14 vol % of a metallic conductor selected from the group consisting of molybdenum disilicide, tungsten disilicide, tungsten carbide, titanium nitride, and mixtures thereof.

In applications involving the MIM igniter disclosed in Willkens '565, the hot zone preferably comprises about 50 to 75 v/o aluminum nitride, and about 8.5–14 v/o $MoSi_2$, and 10–45 v/o SiC, and has a cross section of between 0.0015 and 0.0090 square inches, and an electrical path length of no more than 0.5 cm. More preferably, it comprises about 60 to 70 v/o aluminum nitride, and about 10–12 v/o $MoSi_2$, and 20–25 v/o SiC, and has a cross section of between 0.0030 and 0.0057 square inches, and an electrical path length of between 0.050 inches and 0.200 inches. Most preferably, it comprises about 64 v/o AlN, 11 v/o $MoSi_2$, and 25 v/o SiC, and has a cross section of between 0.0045 and 0.0051 square inches, and an electrical path length of between 0.075 inches and 0.125 inches.

Preferably, the particle sizes of both the starting powders and the grains in the densified hot zone are similar to those described in the Washburn patent. In some embodiments, the average grain size ($d_{50}$) of the hot zone components in the densified body is as follows: a) electrically insulative material (i.e., AlN): between about 2 and 10 microns; b) semiconductive material (i.e., SiC): between about 1 and 10 microns; c) and metallic conductor (i.e., $MoSi_2$): between about 1 and 10 microns.

Conductive ends 9 and 13 provide means for electrical connection to wire leads. Preferably, they also are comprised of AlN, SiC and $MoSi_2$, but have a significantly higher percentage of the conductive and semiconductive materials (i.e., SiC and $MoSi_2$) than do the preferred hot zone compositions. Accordingly, they typically have much less resistivity than the hot zone and do not heat up to the temperatures experienced by the hot zone. The conductive ceramic zone preferably comprises:

(a) between about 15 vol % and about 60 vol % aluminum nitride, (b) between about 20 vol % and about 65 vol % of a semiconductive material selected from the group consisting of silicon carbide and boron carbide, and mixtures thereof, and (c) between about 15 vol % and about 50 vol % of a metallic conductor selected from the group consisting of molybdenum disilicide, tungsten disilicide, tungsten carbide, titanium nitride, and mixtures thereof.

More preferably, the conductive ceramic zone comprises about 20 vol % aluminum nitride, about 60 vol % silicon carbide, and about 20 vol % molybdenum disilicide. In preferred embodiments, the dimensions of conductive ends 9 and 13 are 0.05 cm (width)×4.2 cm (depth)×0.1 cm (thickness). In other embodiments, conductive metal can be deposited upon the heat sink material and hot zone to form the conductive legs.

In some embodiments, the conductive ceramic zone and the hot zone define a hairpin having a pair of legs, and the support zone is disposed between the legs to define a contact length, wherein the support zone contacts (i) the conductive zone substantially along the legs and (ii) the hot zone substantially at the apex. Preferably, the contact between the support and the cold zone comprises at least 80% of the contact length.

The electrical path length of the hot zone, shown as EPL in FIG. 1, is less than 0.5 cm. Insert material 19 is provided as an insert to contact the hot zone and substantially fill the remaining space between the conductive legs extending from the hot zone 11. When paired leads 50 and 51 are attached to each of the conductive ends 9 and 13 and a voltage is applied thereto, current travels from the first lead 50 to first conductive leg 9, through the hot zone 11 (thereby causing the temperature of the hot zone to rise), and then through the second conductive leg 13 where it exits through the second lead 51.

In preferred embodiments, the dimensions of the inserts are 4.0 cm (depth)×0.25 cm (width)×0.1 cm (thickness).

The processing of the ceramic component (i.e., green body processing and sintering conditions) and the preparation of the igniter from the densified ceramic can be done by any conventional method. Typically, such methods are carried out in substantial accordance with the Washburn patent. In preferred embodiments, the green laminates are densified by hot isostatic pressing in a glass media as disclosed in U.S. Pat. No. 5,191,508 ("the Axelson patent"). The densification yields a ceramic body whose hot zone has a density of at least 95%, preferably at least about 99% of theoretical density.

The igniters of the present invention may be used in many applications, including gas phase fuel ignition applications such as furnaces and cooking appliances, baseboard heaters, boilers and stove tops. Generally, there is provided a method of using a ceramic hot surface igniter, comprising the steps of:

a) providing the igniter of the present invention, and b) imparting a voltage between the conductive ceramic ends of the igniter, thereby causing resistive heating of the hot zone and forming a protective layer of mullite on the surface of the support zone.

EXAMPLE I

This example examines the suitability of various compositions for use as support zone inserts.

The ceramic compositions shown below in Table I were created by mixing the selected powders in the appropriate proportions and compacting the mixture into green test samples. These samples were then densified to at least about 99% of theoretical density by glass-encapsulated hot isostatic pressing and finally sandblasted.

There were four criteria for judging suitability. The first, electrical resistivity, was measured at 25° C. An insert having a high electrical resistivity is desirable to insure that the electrical current passing through the hairpin does not bypass the intended route through the conductive and resistive zones. If a material was so resistive that its resistivity was at least 2 mega-ohm at 25° C., then it was judged as "best". If the material had a lower resistivity of no more than 0.5 mega-ohm at 25° C., this was judged as "poor" because its use would likely increase the chance of short circuiting.

The second criterium, oxidation resistance, was measured by static oxidation testing for 18 hours at 1425° C. An insert having an oxide film of no more than 30 um was judged to be the "best", while an insert having an oxide film of at least 80 um was judged to be poor.

The third criterium, coefficient of thermal expansion, was estimated for each material by a rule of mixtures calculation. A material having a CTE of between $5.3\times10^{-6}$/° C. and $5.5\times10^{-6}$/° C. was judged to be good because it would likely not crack upon cooldown from densification when matched against a typical "Washburn" conductive zone (which has a CTE of about $5.4\times10^{-6}$/° c.

The fourth criterium, color match, was evaluated by visual inspection, as compared to the typical Washburn resistive zone. In some applications, it may be desirable to match the color of the insert with that of the resistive zone, while in others it may be desirable to provide a distinctly contrasting color.

Analysis of the below Table indicates a number of preferred ranges.

First, the Table demonstrates clearly that a significant alumina addition is needed in order to provide the correct CTE match with the Washburn type conductive zone. Compare examples 1–5 versus 6–10. Accordingly, it is preferred that the support zone comprises between 2 and 20 vol % alumina, more preferably between 8 and 15 vol % alumina.

TABLE I

| AlN | $Al_2O_3$ | SiC | $MoSi_2$ | Resistivity | Oxidation | CTE (theo.) | Color match |
|---|---|---|---|---|---|---|---|
| 80 | 5 | 15 | 0 | Best | Poor | Good | No |
| 75 | 5 | 20 | 0 | Best | Poor | Good | No |
| 70 | 5 | 25 | 0 | Best | OK | Good | No |
| 75 | 10 | 15 | 0 | Best | Poor | Good | No |
| 70 | 10 | 20 | 0 | Best | Good | Good | No |
| 80 | 0 | 20 | 0 | Best | Poor | Bad | No |
| 70 | 0 | 30 | 0 | Good | Good | Bad | No |
| 60 | 0 | 40 | 0 | Poor | Best | Bad | No |
| 78 | 0 | 20 | 2 | Good | Best | Bad | Yes |
| 76 | 0 | 20 | 4 | Poor | Best | Bad | Yes |

Second, the table shows that a molybdenum disilicide addition is good not only for color, but also for attaining the best oxidation resistance. Compare examples 9–10 versus 1–8. However, it is also clear that additions of more than 4 vol % may undesirably increase the electrical insulating feature of the insert. Therefore, in some embodiments, it is preferred that the insert have between 1 and 4 vol % molybdenum disilicide.

In regards to SiC, the table demonstrates a tradeoff between electrical resistivity and oxidation resistance. The oxidation resistance of the insert is generally good when there is at least 20–30 vol % SiC (suggesting the ability of SiC to form mullite), but the electrical resistivity is generally good when less than 40% used. Therefore, in most embodiments, a SiC fraction of between about 20–35 vol % is desirable, preferably between 25 vol % and 35 vol %, especially if the insert consists essentially of those three components.

The table also shows that providing a small amount of molybdenum disilicide has a dramatic and beneficial effect upon the oxidation resistance of the insert, thereby allowing the SiC level to be lowered to lower levels and providing the desirable distinguishing color to the insert. Therefore, in AlN-SiC-$MoSi_2$-containing systems wherein the SiC level is no more than 25% (preferably between 10 and 25 vol %), the $MoSi_2$ fractions is preferably between 1 and 3 vol %.

EXAMPLE II

This example demonstrates the superior oxidation resistance of the igniter of the present invention.

A green laminate was constructed in substantial accordance with the design shown in FIG. 5 of Willkens '565. A composite powder comprising a hot zone powder mixture of 70.8 v/o AlN, 20 v/o SiC, and 9.2 v/o $MoSi_2$ laid next to an electrically insulating heat sink powder mixture of 60 v/o AlN, 30 v/o SiC, and 10 v/o $Al_2O_3$ was warm pressed to form a billet which was then sliced to form green tile 24 of that FIG. 5. The hot zone portion of the warm pressed green body had a density of about 65% of theoretical density, while the AlN portion had a density of about 65% of theoretical density. The green tiles representing the conductive ends were made by warm pressing powder mixtures containing 20 v/o AlN, 60 v/o SiC, and 20 v/o $MoSi_2$ to form a billet having a density of about 63% of theoretical density, from which tiles 21 and 32 of FIG. 5 were sliced. The green tiles were laminated as in FIG. 5, and then densified by glass-encapsulated hot isostatic pressing at about 1800° C. for about 1 hour to form a ceramic block having an in-situ formed second resistive section. The block was then sliced across its width to produce a plurality of hot surface elements measuring 1.5"×0.150"×0.030" (3.81 cm×0.381 cm×0.076 cm). The resulting hot zone comprised a first resistive section having a depth of about 0.125 cm, and an in-situ formed second resistive section having a depth of about 0.05 cm. The hot zone length (EPL) and thickness were about 0.25 cm and 0.076 cm, respectively.

Suitable leads were attached to the conductive portions of the hot surface element and a voltage of about 30 V was applied. The hot zone attained a temperature of about 1300° C. in less than two seconds.

To test the oxidation resistance of the new support zone, the igniter was subjected to 20,000 cycles of 18 V energy wherein each cycle consisted of a 30 second "on" phase and a 30 second "off" phase. After this test, the surface of the support zone was analyzed for oxidation by measuring oxide thickness. It was found that the oxide thickness was about 50 um. This is about 7–10 times thinner than the oxide thickness measured on the support zone disclosed in Willkens '565.

COMPARATIVE EXAMPLE I

A support zone comprising about 9 vol % silicon nitride, 10 vol % alumina and 81 vol % aluminum nitride was prepared. However, the igniter tile containing this zone and an adjacent conductive zone split during densification. It is believed this tile split because of the CTE mismatch between the support zone and adjacent conductive zone. Because silicon nitride has a very low CTE (3.4×10–6/° C.), it was concluded that its use in the support zone lowers the overall CTE of the support zone to an undesirable level.

COMPARATIVE EXAMPLE II

A support zone comprising about 96 vol % AlN and 4 vol % alumina was prepared. However, it was found that this zone had unacceptable oxidation resistance.

We claim:

1. A ceramic igniter comprising:

(a) a pair of conductive ceramic ends, and (b) a ceramic hot zone disposed between the conductive ceramic ends, and (c) a support zone upon which the hot zone is disposed, wherein the support zone comprises:

(i) between about 50 vol % and about 80 vol % aluminum nitride, and (ii) between about 2 vol % and about 40 vol % of silicon carbide.

2. The igniter of claim 1 wherein the silicon carbide comprises between 10 vol % and 40 vol % of the support zone.

3. The igniter of claim 2 wherein the silicon carbide comprises between 20 and 40 vol % of the support zone.

4. The igniter of claim 2 wherein silicon carbide comprises 20–35 vol % of the support zone.

5. The igniter of claim 2 wherein the support zone further comprises between about 2 vol % and about 20 vol % of a high CTE ceramic having a coefficient of thermal expansion of at least $6\times10^{-6}$/° C.

6. The igniter of claim 5 wherein the high CTE ceramic is alumina.

7. The igniter of claim 6 wherein alumina comprises 5–15 vol % of the support zone.

8. The igniter of claim 6 wherein alumina comprises 8–15 vol % of the support zone.

9. The igniter of claim 6 wherein the conductive ceramic zone and the hot zone define a hairpin having a pair of legs, and the support zone is disposed between the legs to define a contact length, wherein the support zone contacts (i) the conductive zone substantially along the legs and (ii) the hot zone substantially at the apex.

10. The igniter of claim 9 wherein the contact between the support and the cold zone comprises at least 80% of the contact length.

11. The igniter of claim 10 wherein the conductive ceramic zone comprises:

(a) between about 15 vol % and about 60 vol % aluminum nitride, (b) between about 20 vol % and about 65 vol % of a semiconductive material selected from the group consisting of silicon carbide and boron carbide, and mixtures thereof, and (c) between about 15 vol % and about 50 vol % of a metallic conductor selected from the group consisting of molybdenum disilicide, tungsten disilicide, tungsten carbide, titanium nitride, and mixtures thereof.

12. The igniter of claim 11 wherein the hot zone comprises:

(a) between about 50 and about 75 vol % aluminum nitride (b) between about 10 and about 45 vol % of a semiconductive material selected from the group consisting of silicon carbide and boron carbide, and mixtures thereof, and (c) between about 8.5 and about 14 vol % of a metallic conductor selected from the group consisting of molybdenum disilicide, tungsten disilicide, tungsten carbide, titanium nitride, and mixtures thereof.

13. The igniter of claim 6 wherein the support zone further comprises between 1 and 4 vol % molybdenum disilicide.

14. The igniter of claim 1 wherein the hot zone comprises:

(a) between about 50 and about 75 vol % aluminum nitride, (b) between about 10 and about 45 vol % of a semiconductive material selected from the group consisting of silicon carbide and boron carbide, and mixtures thereof, and (c) between about 8.5 and about 14 vol % of a metallic conductor selected from the group consisting of molybdenum disilicide, tungsten disilicide, tungsten carbide, titanium nitride, and mixtures thereof.

15. The igniter of claim 14 wherein the hot zone comprises:

(a) between about 50 and about 75 vol % aluminum nitride, (b) between about 10 and about 45 vol % silicon carbide, and (c) between about 8.5 and about 14 vol % molybdenum disilicide.

16. The igniter of claim 15 wherein the support zone comprises between 10 vol % and 40 vol % SiC.

17. The igniter of claim 16 wherein the support zone further comprises between about 2 vol % and about 20 vol % of a high CTE ceramic having a coefficient of thermal expansion of at least $6\times10^{-6}/°$ C.

18. The igniter of claim 17 wherein the high CTE ceramic is alumina.

19. The igniter of claim 18 wherein the alumina comprises between 8 and 15 vol % of the support zone.

20. The igniter of claim 2 wherein the support zone further comprises:

(c) between about 1 vol % and about 4 vol % of a metallic conductor selected from the group consisting of molybdenum disilicide and tungsten disilicide, and mixtures thereof.

21. The igniter of claim 20 wherein the metallic conductor of the support zone is molybdenum disilicide in the amount of between 1 vol % and 4 vol % of the support zone.

22. The igniter of claim 21 wherein the silicon containing ceramic comprises silicon carbide, and the silicon carbide is present in an amount of between 10 and 25 vol % of the support zone.

23. The igniter of claim 1 wherein the conductive ceramic zone comprises:

(a) between about 15 vol % and about 60 vol % aluminum nitride, (b) between about 20 vol % and about 65 vol % of a semiconductive material selected from the group consisting of silicon carbide and boron carbide, and mixtures thereof, and (c) between about 15 vol % and about 50 vol % of a metallic conductor selected from the group consisting of molybdenum disilicide, tungsten disilicide, tungsten carbide, titanium nitride, and mixtures thereof.

24. The igniter of claim 23 wherein the conductive ceramic zone comprises:

(a) about 20 vol % aluminum nitride, (b) about 60 vol % silicon carbide, and (c) about 20 vol % molybdenum disilicide.

25. A method of using a ceramic hot surface igniter, comprising the steps of:

a) providing a ceramic igniter comprising:

(i) a pair of conductive ceramic ends, (ii) a ceramic hot zone disposed between the conductive ceramic ends, and (iii) a support zone upon which the hot zone is disposed, wherein the support zone comprises:

between about 50 vol % and about 80 vol % aluminum nitride, and between about 2 vol % and about 40 vol % of silicon carbide, and b) imparting a voltage between the conductive ceramic ends of the igniter, thereby causing resistive heating of the hot zone and forming a protective layer of mullite on the surface of the support zone.

26. A densified polycrystalline ceramic comprising:

a) between 50 and 80 vol % aluminum nitride, b) between 25 and 35 vol % SiC, and c) between 8 and 15 vol % alumina.

27. The ceramic of claim 26 consisting essentially of:

a) between 50 and 80 vol % aluminum nitride, b) between 25 and 35 vol % SiC, and c) between 8 and 15 vol % alumina.

28. A densified polycrystalline ceramic comprising:

a) between 50 and 80 vol % aluminum nitride, b) between 10 and 25 vol % SiC,

C) between 8 and 15 vol % alumina, and d) between 1 and 4 vol % molybdenum disilicide.

* * * * *